US007455507B2

(12) United States Patent
Takahashi et al.

(10) Patent No.: US 7,455,507 B2
(45) Date of Patent: Nov. 25, 2008

(54) STRUCTURE FOR PREVENTING CAVITATION EROSION OF OIL PUMP

(75) Inventors: Miyuki Takahashi, Kanagawa-ken (JP); Hidenori Egashira, Kanagawa-ken (JP); Ryou Abe, Kanagawa-ken (JP)

(73) Assignee: Misubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 11/727,105

(22) Filed: Mar. 23, 2007

(65) Prior Publication Data

US 2007/0231179 A1 Oct. 4, 2007

(30) Foreign Application Priority Data

Mar. 29, 2006 (JP) ..... 2006-092124

(51) Int. Cl.
*F03C 2/00* (2006.01)
*F04C 2/00* (2006.01)

(52) U.S. Cl. ..... 418/132; 418/131; 418/206.1; 418/206.6; 418/206.7

(58) Field of Classification Search ..... 418/88, 418/131, 132, 144, 191, 197, 201.1, 205, 418/206.1, 206.6

See application file for complete search history.

(56) References Cited

U.S. PATENT DOCUMENTS

| | | | | | |
|---|---|---|---|---|---|
| 2,134,153 | A | * | 10/1938 | Seyvertsen | 418/206.6 |
| 3,104,616 | A | * | 9/1963 | Peet | 418/132 |
| 3,961,872 | A | * | 6/1976 | Muller et al. | 418/132 |
| 4,056,337 | A | * | 11/1977 | Zorn et al. | 418/131 |
| 5,022,837 | A | * | 6/1991 | King et al. | 418/132 |
| 5,312,236 | A | * | 5/1994 | Kishimoto | 418/206.1 |

FOREIGN PATENT DOCUMENTS

JP 2002-266613 9/2002

* cited by examiner

*Primary Examiner*—Theresa Trieu
(74) *Attorney, Agent, or Firm*—Wenderoth, Lind & Ponack, L.L.P.

(57) ABSTRACT

A side face of a pump gear is formed into a stepped face such that an annular region extending radially from a diameter which is smaller than a dedendum circle diameter of the pump gear and larger than the outer diameter of a pump gear bearing to the addendum circle diameter of the pump gear is recessed by a certain depth to increase the side gap in the recessed annular region. Therefore, the side gap in the recessed annular region is larger than a side gap in a region between the diameter smaller than the dedendum circle diameter of the pump gear and larger than the outer diameter of the pump gear bearing to the outer diameter of the pump gear bearing.

3 Claims, 3 Drawing Sheets

STRUCTURE FOR PREVENTING CAVITATION EROSION OF OIL PUMP

BACKGROUND OF THE INVENTION

1. Field of the Invention

The present invention relates to a structure for preventing cavitation erosion mainly applied to gear type oil pumps for diesel engines. The oil pump is constructed such that pump gears engaging each other are accommodated in a pump case in a state in which the gap between a side face of the gear and a side wall face of a gear room of the pump case and/or the gap between the other side face of the pump gear and the side end face of the pump cover are very small so that oil leakage through the gaps is a minimum and oil is discharged from the pump by the rotation of the pump gears.

2. Description of the Related Art

Gear pumps such as, for example, disclosed in Japanese Laid-Open Patent Application No. 2002-266613, in which a gear pump has gears driven by a pump drive gear connected to a crankshaft of an engine to supply lube oil to the engine, are widely used for diesel engines.

In such a gear pump for feeding oil, gears engaging each other are accommodated in a pump case in a state in which the gaps between both the side faces of the gears and the side wall face of a gear room of a pump case and the pump gear side end face of the pump cover are very small so that oil leakage through the gaps is a minimum, in order to prevent reduction in volumetric efficiency.

In the gear pump as disclosed in JP2002-266613A, oil introduced in tooth grooves in the suction room of the oil pump is discharged to the tooth grooves in the discharge room of the oil pump as the gears engaging each other are rotated. When oil is excluded from the tooth groves in the meshing part, a part of the oil is enclosed in the meshing part and compressed therein to high pressure, and leaks through the side gaps at the meshing part to the suction room where oil pressure is low.

The side gaps are made very small to a minimum in order to attain high volumetric efficiency of the pump. So, the high pressure oil enclosed in the meshing part flows through the very small gaps at very high speed toward the suction room where oil pressure is low, and cavitation tend to occur at the very small side gaps near the meshing part and cavitation erosion tends to occur there.

SUMMARY OF THE INVENTION

The present invention was made in light of the problem of prior art mentioned above. The object of the invention is to provide a structure of an oil pump for preventing occurrence of cavitation erosion at the very small gap between the side face of the pump gear and the side wall of the pump room.

The present invention was made to attain the object, and proposes a structure for preventing cavitation erosion of an oil pump which is constructed such that pump gears engaging each other and driven by a pump drive gear are accommodated in a pump case in a state in which side gaps between both of the side faces of the gears and a side wall face of a gear room of the pump case and a pump gear side end face of a pump cover are very small and oil is discharged from the pump by the rotation of the engaging gears. A side face of the pump gear is formed into a stepped face such that an annular region extending radially from a diameter which is smaller than the dedendum circle diameter of the pump gear and larger than the outer diameter of a pump gear bearing to the addendum circle diameter of the pump gear is recessed by a certain depth to increase the side gap in the recessed annular region so that the side gap in the recessed annular region is larger than a side gap in a region between the diameter smaller than the dedendum circle diameter of the pump gear and larger than the outer diameter of the pump gear bearing to the outer diameter of the pump gear bearing.

In the invention, it is preferable that:

(1) The recessed annular region is formed on a side face of the pump gear facing the pump gear side end face of the pump cover, or (2) The recessed annular region is formed on a side face of the pump gear facing the side wall face of the gear room of the pump case.

It is possible to construct a structure such that the characteristic of (1) and (2) are provided at the same time.

According to the invention, the side face of the pump gear is formed into a stepped surface having a recessed side face recessed by a certain depth over an annular range extending radially from a diameter which is smaller than the diameter of the dedendum circle of the pump gear and larger than the outer diameter of the pump gear bearing to the outer circumference of the pump gear so that the side gap in the range of the recessed side face is larger than the side gap in the range extending radially from the outer diameter of the pump gear bearing to the inner diameter of the recessed portion. As a result high pressure oil enclosed in the meshing part of the pump gears in the discharge side leaks to the suction room through the relatively large gap at the recessed portion.

As the high pressure oil enclosed in the meshing part of the pump gears is released to the suction room through the larger side gap in the recessed portion, even when the pump gears have moved in an axial direction in the pump case room, a situation in which the side clearance becomes excessively small can be evaded. Therefore, flow velocity of the high pressure oil when released to the suction room can be reduced compared with the case in which the high pressure oil is released through a very small side gap of a usual gear pump.

By virtue of reduced velocity of the high pressure oil when being released to the suction room, a pressure drop at the recessed portion near the meshing part of the pump gears is reduced, occurrence of cavitation there is suppressed, and occurrence of cavitation erosion can be prevented.

The side clearance at the recessed portion is determined such that it is not so large as to induce an increase in leakage of oil from the discharge room to the suction room through the side clearance. Thus, reduction of volumetric efficiency of the gear pump due to the leakage through the side clearance of the recessed region is suppressed to a minimum. Further, the side clearance in the range from the outer diameter of the pump gear bearing to the inner diameter of the recessed portion is determined to be very small as is in usual gear pumps. Thus, oil leakage through the side clearance in this range is maintained similar to usual gear pumps, so that reduction in volumetric efficiency due to forming a recessed region can be evaded sufficiently.

Therefore, according to the invention, a structure for preventing cavitation erosion can be provided with which occurrence of cavitation erosion in the very small gaps between the side faces of the pump case and pump cover can be prevented while suppressing reduction in volumetric efficiency of the gear pump.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only and not as a limit of the scope of the present invention.

Figure 1:
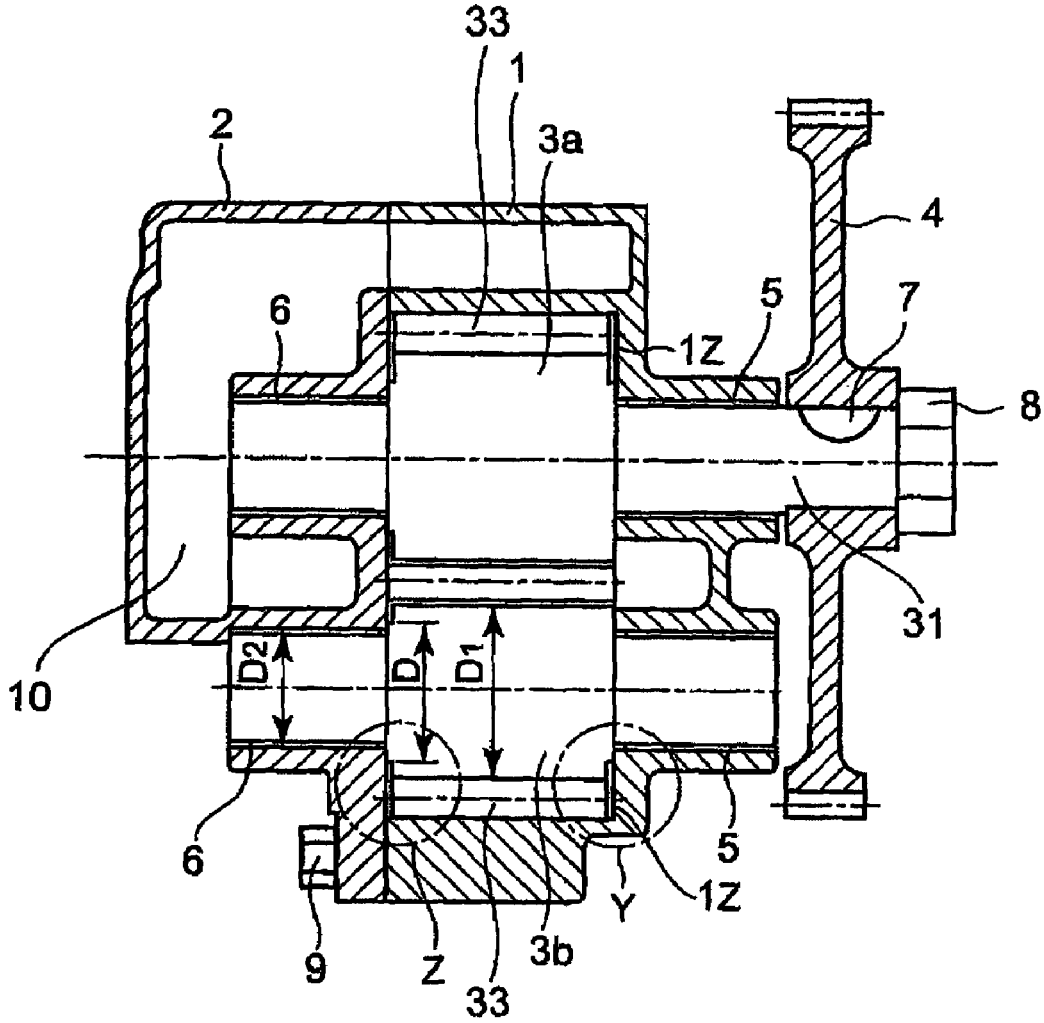
FIG. 1 is a longitudinal cross sectional view of an embodiment of the gear pump for a diesel engine.
Figure 2:
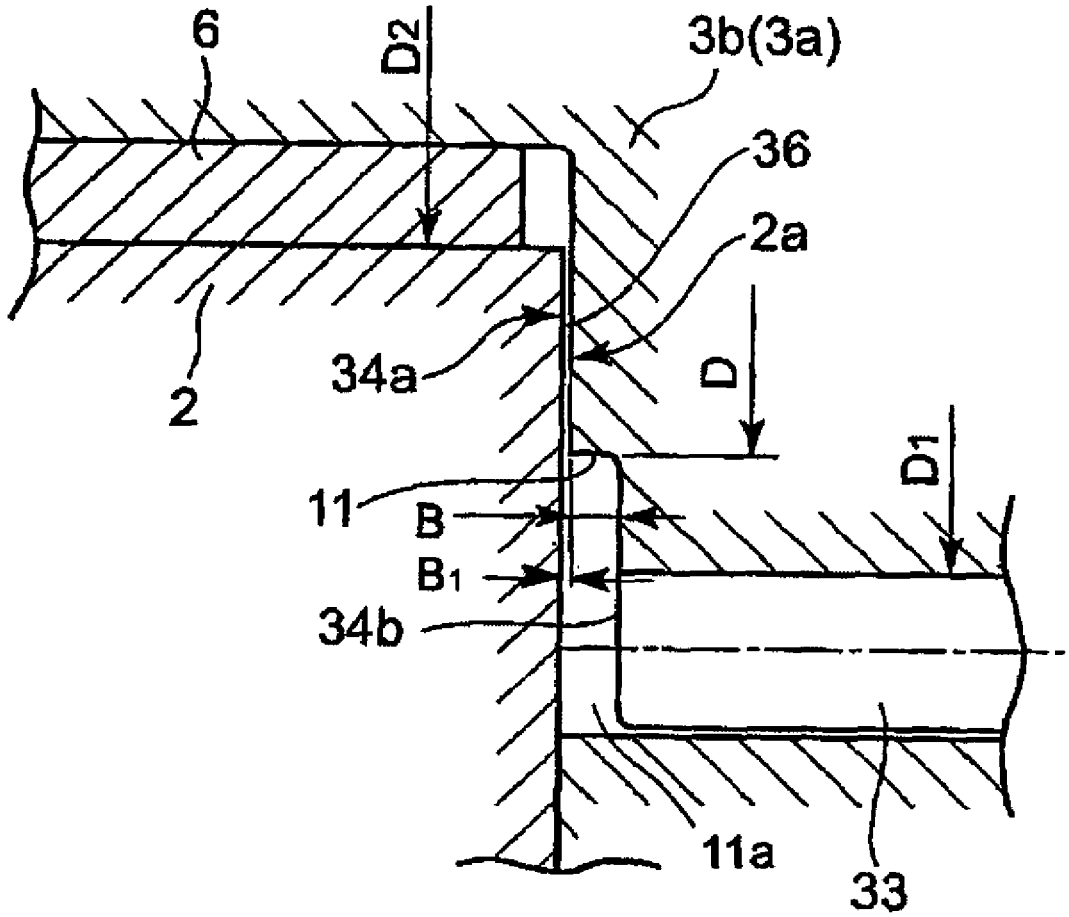
FIG. 2 is an enlarged sectional view of part Z and Y in FIG. 1.

FIG. 1 is a longitudinal cross sectional view of an embodiment of the gear pump for a diesel engine, FIG. 2 is an enlarged sectional view of parts Z and Y in FIG. 1. FIG. 3A is a side view of the drive side gear of FIG. 1 and FIG. 3B is an enlarged side view of parts W and V in FIG. 3A.

Figure 3:
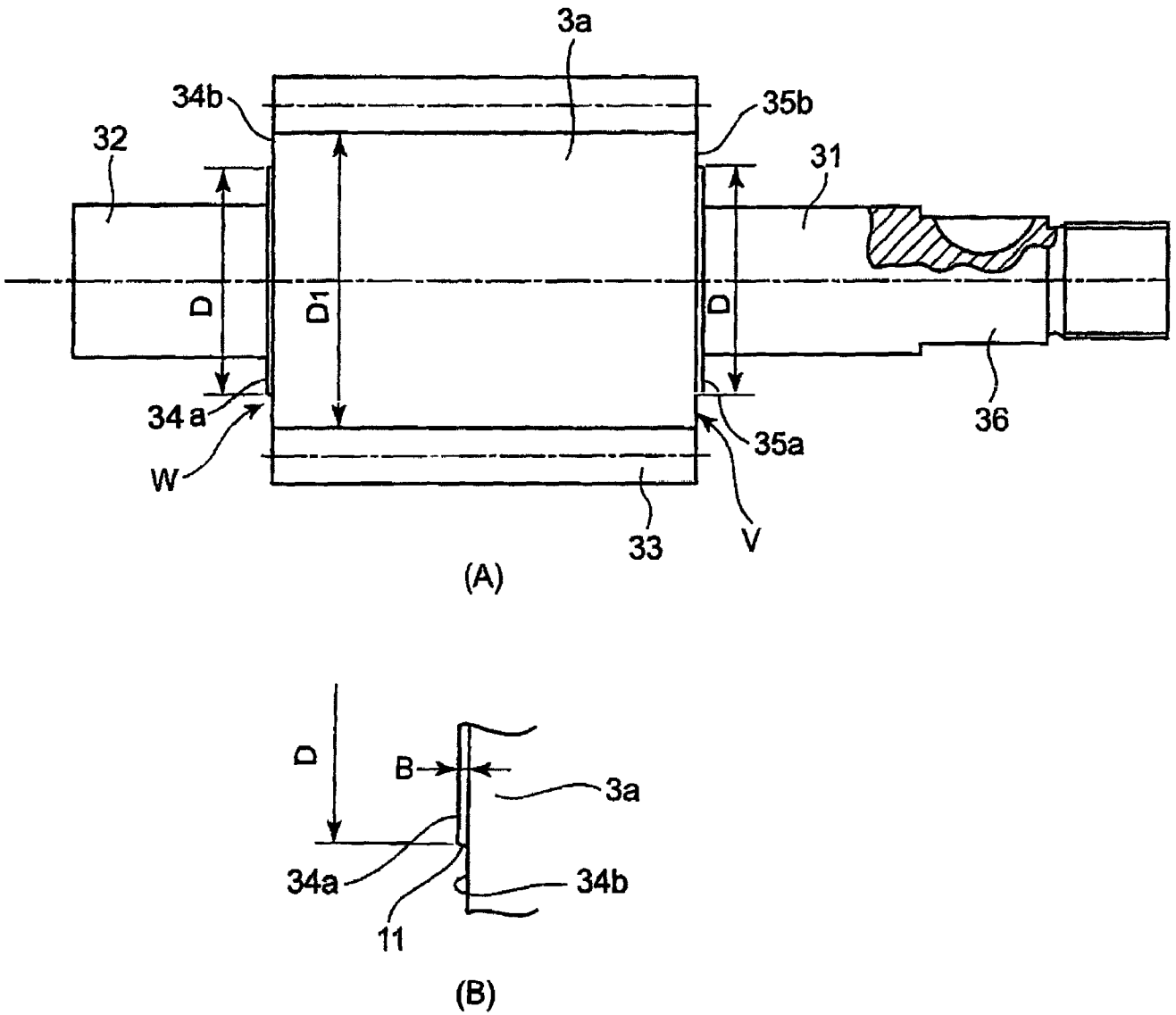
FIG. 3A is a side view of the drive side gear of FIG. 1
FIG. 3B is an enlarged side view of part W and V in FIG. 3A.

Although the gear pump shown in FIGS. 1-3 is a double-gear type gear pump, the present invention is also applicable to a three-gear type gear pump.

Referring to FIGS. 1-3, reference numeral 1 indicates a pump case, and 2 indicates a pump cover covering the side faces of the pump gears 3*a* and 3*b* mentioned later and fixed to the pump case 1 with a plurality of bolts 9. Reference numerals 3*a*, 3*b* indicate pump gears engaging each other in the pump case 1, of which 3*a* is a drive side pump gear which is formed in one piece with a pump drive shaft 31 as shown in FIG. 3. Reference numeral 4 indicates a pump drive gear fixed to an end of the pump drive shaft 31 by means of a nut 8, and reference number 7 indicates a key for preventing rotation of the pump drive gear 4 relative to the pump drive shaft 31. The pump gears 3*a*, 3*b* are supported for rotation by pump gear bearings 5, 5 fixed to the pump case 1 and by pump gear bearings 6, 6 fixed to the pump cover 2. Reference numeral 10 indicates a suction room into which oil is introduced, and a discharge room not shown in FIG. 1 is formed at the opposite side of the suction room 10 across the pump gears 3*a*, 3*b*.

The above construction is the same as that of a usual gear pump.

The present invention relates to a structure for preventing occurrence of cavitation erosion in gear pumps constructed as mentioned above.

As shown in FIG. 2, a side face 34*a* of the pump gear 3*b* facing the gear side end face 2*a* of the pump cover 2 is formed into a stepped face such that an annular region extending radially from a diameter D (which is smaller than the diameter D1 of the dedendum circle of the pump gear and larger than the outer diameter D2 of the pump gear bearing 6) to the diameter of the addendum of teeth 33 of the pump gear is recessed by a certain depth B. A recessed side face 34*b* is the bottom face of the annular recession and reference numeral 11 is a shoulder.

The gap between the side face 34*a* of the pump gear 3*b* and the gear side end face 2*a* of the pump cover 2 is B1 over a range from the diameter D2 of the pump gear bearing 6 to the diameter D at the shoulder 11 of the recession. This gap B1 is determined similar to the case of a usual gear pump, so the gap 11*a* is increased by the depth B over the range between the diameter D to the outer circumference of the pump gear 3*b* as compared to the case of a usual gear pump.

The above explanation was done on the pump gear 3*b*. Similar recessing is done on the pump gear 3*a* at a part of the side face facing the pump gear side end face of the pump cover 2.

A recessed side face 35*b* similar to the recessed side face 34*b* may be provided for the pump gear 3*b* or 3*a* on its side face 34*a* or 35*a* facing the side wall face 1*z* of the gear room of the pump case 1, as shown in the part Y in FIG. 1 and part V in FIG. 3.

Further, the recessed face 34*b* or 35*b* may be provided for both the side face 34*a* of the pump gear 3*a* facing the pump gear side end face 2*a* of the pump cover 2 and the side face 35*a* of the pump gear 3*a* facing the side wall face 1*z* of the gear room of the pump case 1, as necessary.

When the pump gears 3*a*, 3*b* engaging each other are driven by the pump drive gear 4 geared to the crankshaft to be rotated in opposite rotation directions, oil entering into the tooth grooves in the suction room 10 is pressurized and discharged to the discharge room as the gears rotate.

According to the embodiment, the side faces of the pump gears 3*a*, 3*b* are formed into stepped surfaces having a recessed side face 34*b* or 35*b* recessed from the side face 34*a* or 35*a* by a certain depth of B over an annular region from the diameter D which is smaller than the diameter D1 of the dedendum circle of the pump gear 3*a*, 3*b* and larger than the outer diameter D2 of the pump gear bearing 6 to the addendum of the teeth 33 of the pump gear. Therefore, high pressure oil enclosed in the meshing part of the pump gears 3*a*, 3*b* in the discharge room is released to the suction room 10 through the relatively large gap 11*a* at the recessed side face 34*b* or 35*b* at the meshing part of the pump gears.

The high pressure oil enclosed in the meshing part of the pump gears is released to the suction room 10 through the gap 11*a* which is the sum of the gap B1 and the depth B of the recess, and the depth B is determined to be relatively large. Therefore, even when the pump gears have moved in an axial direction in the pump case room, a situation in which the side clearance becomes excessively small can be evaded, because there remains the depth B as a gap to release the high pressure oil to the suction room. Therefore, flow velocity of the high pressure oil when released to the suction room can be reduced compared with the case the high pressure oil is released through a very small side gap of a usual gear pump.

By virtue of reduced velocity of the high pressure oil when being released to the suction room, pressure drop at the recessed side face 34*b* or 35*b* near the meshing part of the pump gears is reduced, occurrence of cavitation there is suppressed, and occurrence of cavitation erosion can be prevented.

The depth B of the recessed part 34*b* or 35*b* is determined such that it is not so large as to induce an increase in leakage of oil from the discharge room to the suction room 10. Thus, reduction of volumetric efficiency of the gear pump due to the leakage through the gap at the recessed side face 34*b* or 35*b* is suppressed to a minimum. Further, the side gap B1 in the range from the outer diameter D2 of the pump gear bearing 6 and the inner diameter D of the recessed side face 34*b* or 35*b* is determined to be smaller than the depth of the recessed side face 34*b* or 35*b*, with the gap B1 being very small similar to usual gear pumps. Therefore, oil leakage through the gap B1 is maintained similar to usual gear pumps, and reduction in volumetric efficiency due to forming the recessed side face 34*b* or 35*b* can be sufficiently avoided.

Therefore, according to the present invention, a structure for preventing cavitation erosion in a gear type oil pump can be provided. Specifically, occurrence of cavitation erosion in the very small gaps between the side faces of the pump case 1 and pump cover 2 can be prevented while suppressing reduction in volumetric efficiency of the gear pump.

According to the present invention, a structure of an oil pump for preventing cavitation erosion can be provided with which occurrence of cavitation erosion in very small side gaps between the side faces of the pump gear and side faces of the pump case and pump cover can be prevented without inducing reduction in volumetric efficiency of the gear pump.

The invention claimed is:

1. A structure for preventing cavitation erosion of an oil pump, comprising:

pump gears engaging each other and driven by a pump drive gear, the pump gears being accommodated in a pump case such that small side gaps are defined between both side faces of the pump gears and a side wall face of a gear room of the pump case and a pump gear side end face of a pump cover and such that oil is discharged from the pump by rotation of the engaged pump gears, wherein a side face of the pump gear is formed into a stepped face such that an annular region extending radially from a diameter of a shoulder at the stepped face, the diameter of the shoulder at the stepped face being smaller than a dedendum circle diameter of the pump gear and larger than an outer diameter of a pump gear bearing, to an addendum circle diameter of the pump gear is recessed by a certain depth to increase a size of a side gap in the recessed annular region so that the size of the side gap in the recessed annular region is larger than a size of a side gap in a region between the diameter of the shoulder at the stepped face to the outer diameter of the pump gear bearing.

2. A structure for preventing cavitation erosion of an oil pump according to claim 1, wherein the recessed annular region is formed on a side face of the pump gear facing the pump gear side end face of the pump cover.

3. A structure for preventing cavitation erosion of an oil pump according to claim 1, wherein the recessed annular region is formed on a side face of the pump gear facing the side wall face of the gear room of the pump case.

* * * * *